United States Patent [19]

Heil

[11] 4,056,697

[45] Nov. 1, 1977

[54] MOVABLE DIAPHRAGM CONNECTOR METHOD FLEXIBLE HINGE DIAPHRAGM SURROUND AND ELECTRO-ACOUSTIC TRANSDUCER WITH FOLDED DIAPHRAGM WITH INTERMEDIATE FLEXIBLE PORTIONS

[76] Inventor: Oskar Heil, 1775 Parrott Drive, San Mateo, Calif. 94402

[21] Appl. No.: 720,279

[22] Filed: Sept. 3, 1976

[51] Int. Cl.[2] ..... H04R 7/12; H04R 7/18; H04R 9/02

[52] U.S. Cl. ..... 179/115.5 PV; 181/164; 181/171

[58] Field of Search ..... 179/115.5 R, 115.5 PV; 181/157, 163, 164, 172, 173, 171

[56] References Cited

U.S. PATENT DOCUMENTS

| | | | |
|---|---|---|---|
| 1,566,337 | 12/1925 | Martin | 181/173 |
| 2,513,171 | 6/1950 | Hassan | 179/115.5 R |
| 3,636,278 | 1/1972 | Heil | 179/115.5 PV |
| 3,832,499 | 8/1974 | Heil | 179/115.5 PV |

FOREIGN PATENT DOCUMENTS

| | | | |
|---|---|---|---|
| 306,692 | 2/1929 | United Kingdom | 179/115.5 R |

*Primary Examiner*—George G. Stellar
*Attorney, Agent, or Firm*—Robert R. Tipton

[57] ABSTRACT

A sound reproducing movable diaphragm utilizes a three hinge, double rigid member arrangement for connecting a movable diaphragm to a fixed member or baffle or adjacent movable diaphragm in order to decouple unwanted distortions and resonances from the system.

3 Claims, 10 Drawing Figures

MOVABLE DIAPHRAGM CONNECTOR METHOD FLEXIBLE HINGE DIAPHRAGM SURROUND AND ELECTRO-ACOUSTIC TRANSDUCER WITH FOLDED DIAPHRAGM WITH INTERMEDIATE FLEXIBLE PORTIONS

BACKGROUND OF THE INVENTION

This invention relates generally to vibratory sound reproduction apparatus and in particular to devices for connecting sound reproduction diaphragms to a fixed baffle or other sound reproduction diaphragms.

If a loudspeaker diaphragm emits sound waves whose wavelengths are comparable to its lateral dimensions, the emitted sound is strongly diminished by the air flowing around the edge of the diaphragm from the front to rear and back again. This flow of air diminishes the build-up of air pressure necessary for sound generation.

To prevent this air flow from occurring, the diaphragm surface is generally extended with a baffle or a box which can be completely closed (air suspension), partially closed (bass reflex) or open in the rear. For these configurations, it becomes necessary to close the space between the moving diaphragm and the baffle or fixed surface so that it is practically air tight. The flexible element which closes this air space is defined as the "surround."

In the apparatus of the prior art, the sound reproduction diaphragms were generally connected to the fixed baffle by means of a corrugated fabric or flexible material which stretched and vibrated with the movable diaphragm. This connecting material also generated various harmonic frequencies and resonant distortions which degrade the sound reproduction fidelity of the system. These resonances must be destroyed to obtain good sound reproduction. The usual prior art technique for for correcting such problems was to impregnate the fabric or coat the material with a sound dampening material such as silicon rubber or other material having a high internal friction.

Generally the materials used are leather, rubber or high viscosity plastics, foam rubber or loose woven cloth impregnated or coated with latex or similar high viscosity semi-liquid components. This damping effect was reflected in the sound reproduction characteristics of the movable diaphragm to limit fidelity.

The damping material as well as the connecting material used in prior art devices also produced its own distortions depending on sound frequency as to whether the individual fibers of the material would cause distortion through rubbing against themselves or as result of harmonic frequencies generated by the material operating in the elastic mode.

SUMMARY OF THE INVENTION

The apparatus of the present invention for connecting a movable diaphragm to a fixed baffle or to an adjacent movable diaphragm utilizes a pair of rigid members which are hinged to each other along one edge and also hinged, respectively, along their remaining edges, one rigid member hingedly connected to said movable diaphragm and the other rigid member hingedly connected to the fixed baffle or and adjacent movable diaphragm.

It is, therefor, an object of the present invention to provide a method of hinging a movable diaphragm to a fixed baffle or an adjacent movable diaphragm.

It is a further object of the present invention to provide a method of hinging a movable diaphragm to reduce resonant distortion.

It is another object of the present invention to provide a connector for a movable diaphragm having minimum energy loses.

It is still another object of the present invention to provide a connector for a movable diaphragm using hinged rigid members.

It is still a further object of the present invention to provide a connector for a movable diaphragm utilizing flexible hinges and rigid members.

It is still a further object of the present invention to provide a connector for a movable diaphragm having low acoustic distortion.

These and other objects of the present invention will be manifest upon review of the following detailed description when taken together with the drawings.

DESCRIPTION OF THE PREFERRED EMBODIMENT

For loudspeakers of the configuration as dislcosed and claimed in applicants issued U.S. Pat. No. 3,636,278, where the diaphragm consists of many parts which move relative to each other, these parts must also be joined to each other with flexible air-tight elements referred to and defined as "surrounds."

The size of these surrounds relative to the diaphragm can also vary, in some cases, the surround can be larger in area than the area of the movable diaphragm.

In the present invention, the resonant fequencies of the surround are not broadened by damping to the point where they cannot be recognized. In the present invention, the resonant frequencies are not damped at all. They are, instead, moved up in frequency to values which are out of the reproduction range of the speaker.

For high frequency speakers, such as that disclosed and claimed in U.S. Pat. No. 3,636,278, they are moved beyond the audible range of the human ear, that is, beyond 20,000 Hz. For low frequency speakers, the resonances are moved well above the reproduction range which is limited by the upper cross-over frequency of the speaker.

These resonances are raised by utilizing two narrow, very rigid, light weight strips or members which are joined to each other with a narrow, very flexible element referred to generally as a hinge.

This rigid, foldable element is joined with a second hinge to the diaphragm and then with a third hinge to the baffle or restoring element of the speaker. In order to be able to surround the speaker, the hinged combination must have the shape of a polygon. The number of sides should be small, somewhere between 4 and 8. For a configuration of 3 sides, the length of the surround per surface area of the diaphragm is large. Above 8 sides, the area of the diaphragm per surround length does not increase appreciably, however, the number of corners that must be made air-tight becomes too high.

Methods of making the corners air-tight include posts (FIG. 6) having a narrow air gap between diaphragm surround and post, and joining corners with a very pliable skin.

The resonant frequencies of the rigid strips or members is very high as a result of their light weight and rigidity. The resonant frequency of the hinge portion is also very high because of their small width.

Figure 1:
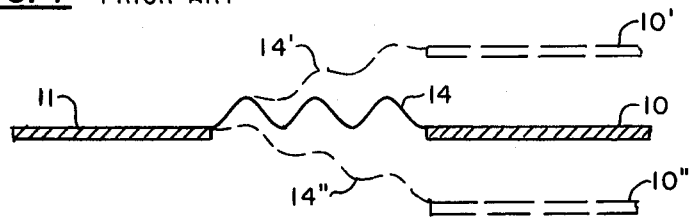
FIG. 1 PRIOR ART
FIG. 1 is a sectional elevational view of the prior art method of connecting a movable diaphragm to a fixed surround.

With reference to FIG. 1 there is illustrated the typical prior art method of connecting movable diaphragm to fixed member or baffle 11 using a flexible corrugated member 14. Member 14 is generally fabricated from a woven textile material, layered fiber material, or the like, which has been treated with a damping material such silicon rubber.

The upward movement of diaphragm 10 is illustrated by dashed lines showing diaphragm 10' raised above the level of member 11 thus stretching or pulling corrugated material 14 to the position shown as 14'. The maximum downward movement of diaphragm 10 is shown in dashed lines for diaphragm 10'' stretching or pulling connector material 14'' to its lower position as shown.

It can be seen that, as diaphragm 10 moves up and down, flexible member 14 is alternately stretched up and down with the movement of diaphragm 10, and in addition, because of its own mass, it will tend to vibrate in a harmonic manner depending upon its resilience and length between points of attachement to fixed member 11 and diaphragm 10.

Figure 2:
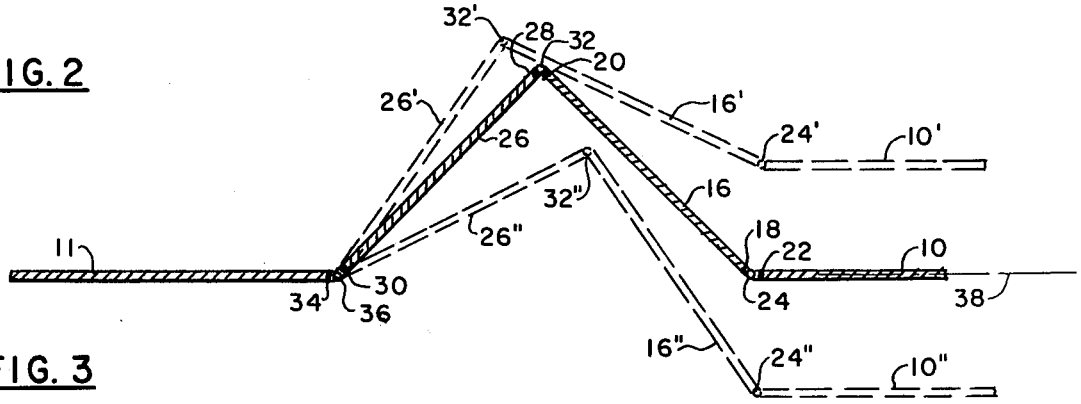
FIG. 2 is a sectional view of the hinged method of the present invention connecting a movable diaphragm to a fixed surround.

With reference to FIG. 2, there is illustrated the connector device of the present invention which comprises, basically, a first rigid, generally elongated member 16 having elongated parallel edges 18 and 20 in which edge 18 is connected to edge 22 of diaphragm 10 by means of hinge 24.

A second rigid member 26, also having elongated parallel edges 28 and 30, is connected at edge 28 to edge 20 of rigid member 16 by means of hinge 32.

Edge 30 of rigid member 26 is in turn connected to edge 34 of fixed member 11 by means of hinge 36. Further, the width of rigid members 16 and 26 relative to the space between diaphragm 10 and member 11 is established such that first rigid member 16 is disposed at an angle to planar axis 38 of diaphragm 10 with second rigid member 26 disposed at an opposite angle to the planar axis 38 of diaphragm 10.

The direction of motion of diaphragm 10 is, of course, perpendicular to planar axis 38.

As can be seen in FIG. 2, the upward position of diaphragm 10 shown by diaphragm 10', which has moved first rigid member 16 and second rigid member 26 to the positions shown as 16' and 26' and to a lower position of 10'' with movement accordingly of first rigid member 16 to the position of 16'' and second rigid member 26 to the position of 26''.

It can also be seen that such movement is permitted by the particular two rigid member, three hinged configuration of the diaphragm connector apparatus of the present invention.

Figure 3:
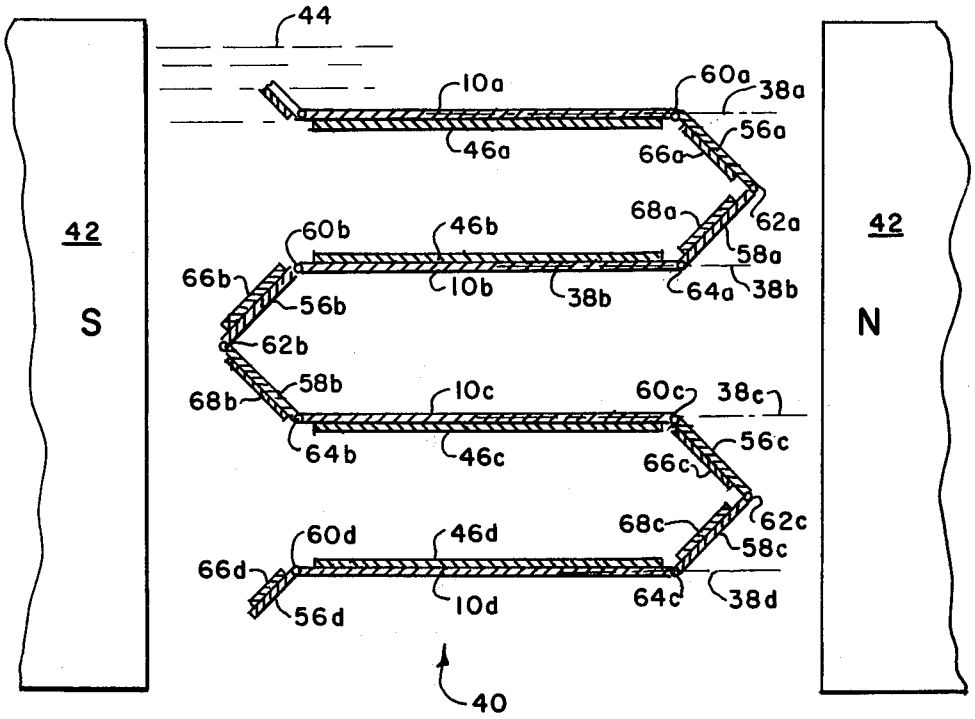
FIG. 3 is a sectional view showing the method of connecting a movable diaphragm to an adjacent movable diaphragm of the present invention.

With reference to FIG. 3, there is illustrated a folded diaphragm configuration 40 utilizing the basic configuration of the connector device for the movable diaphragm of FIG. 2, however, in FIG. 3, there is illustrated the case where it is used to connect two adjacent movable diaphragms to each other.

In FIG. 3, folded diaphragm 40 comprises a plurality of generally parallel, spaced apart, generally elongated planar diaphragms **10*a*, 10*b*, 10*c*, 10*d*, etc., defining a plurality of adjacent narrow air spaces and with each planar diaphragm adapted to move in a direction perpendicular to the planar axis 38*a*, 38*b*, 38*c*, etc., of each diaphragm 10**.

For convenience, when referring to all diaphragms **10*a*, 10*b*, 10*c* 10*d*,** etc., the suffix letter will not be used.

Folded diaphragm 40 is located between the north and south poles of permanent magnet 42 with the planar axis 38 of each planar diaphragm 10 parallel to the magnetic lines of force 44. Conductors 46 are attached to diaphragms 10, namely, conductor **46*a* attached to diaphragm 10*a*, conductor 46*b* attached to diaphragm 10*b*, conductor 46*c* attached to diaphragm 10*c*, etc. with each conductor serially connected to its adjacent conductor so that an electric current will flow in opposite directors with respect to adjacent planar diaphragms. Thus it can be seen that a current flowing through conductors 46 will produce forces on diaphragms 10 to cause alternate diaphragms to move toward and away from each other. For example, a flow of current in one direction would cause diaphragms 10*a* and 10*b* to move toward each other, diaphragms 10*b* and 10*c* to move away from each other, and diaphragms 10*c* and 10*d* to move toward each other. An oppositely flowing current through conductors 46 would cause diaphragms 10*a* and 10*b* to move away from each other, diaphragms 10*b* and 10*c* to move toward each other and diaphragms 10*c* and 10*d* to move away from each other. Thus an alternating current through conductor 46 would result in vibrations of planar diaphragms 10 which would result in air being pushed out of one side of folded diaphragm 40 while simultaneously being pulled in from the other side of folded diaphragm 40**.

Closing the folds between adjacent diaphragms 10 and providing closures for adjacent pairs of diaphragms 10 facing in opposite directions, are generally elongated rigid members 56 and 58, each having elongated parallel edges.

In particular, one edge of elongated member **56*a* is connected to one edge of diaphragm 10*a* by means of hinge 60*a*, while the other edge of elongated member 56*a* is conneced to one edge of elongated member 58*a* by means of hinge 62*a*, with the remaining edge of rigid member 58*a* connected to diaphragm 10*b* by means of hinge 64*a***.

In a like manner, generally elongated rigid member **56*b* is connected to diaphragm 10*b* by means of hinge 60*b* with the other edge of elongated member 56*b* connected to one edge of rigid member 58***a* by means of hinge 62*b*, with the remaining edge of rigid member 58*b* connected to diaphragm 10*c* by hinge 64*b*. The other closure members between diaphragm 10*c* and 10*d* are connected in a like manner.

It can be seen as diaphragms 10*a*, 10*b*, 10*c* and 10*d* move toward and away from each other, that the hinging action of hinges 60, 62 and 64 will permit such movement.

The hinge in all of these embodiments can include piano hinges, pivots or narrow flexible members fabricated from thin spring metal or plastics such as polycarbonate plastics. For example, folded diaphragm 40 can be fabricated from a sheet of flexible plastic material on which hinges 60, 62 and 64 can be embossed. Rigid members 56 and 58 can be fabricated by embossing alternating ribs in the plastic in order to mechanically rigidize the plastic between hinge portions 60, 62 and 64. These members can also be rigidized by providing a plating of aluminum of other metal 66 and 68 of sufficient thickness between hinges 60, 62 and 64, sufficient to rigidize the plastic material.

Diaphragms 10 can be rigidized through the use of the same metallic coating which also functions as conductor 46.

Thus diaphragms 10 are connected to each other by rigid closures which are hinged to allow for movement of the diaphragms.

Figure 4:
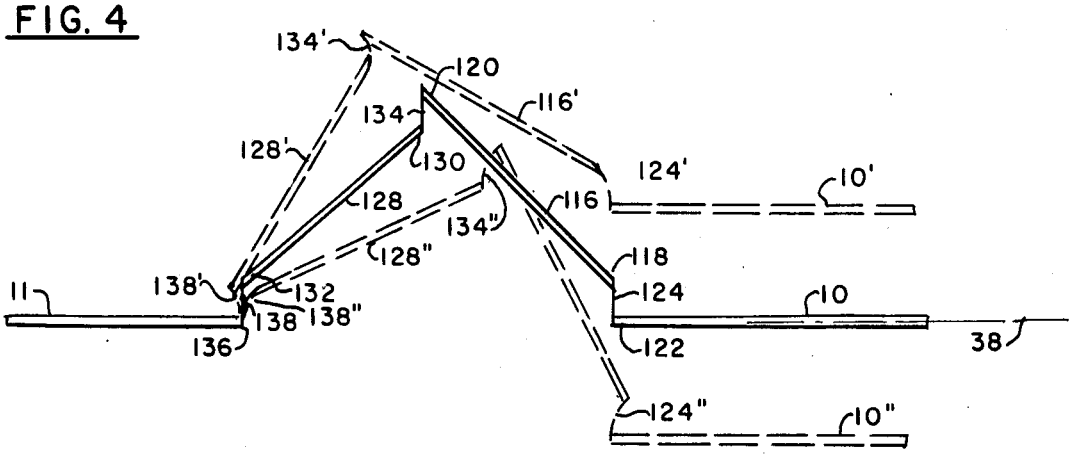
FIG. 4 is another embodiment of the apparatus of the present invention for connecting a movable diaphragm to a fixed surround utilizing flexible hinges.

With reference to FIG. 4 there is illustrated a further embodiment of the connector device of the present invention in which movable diaphram 10 is connected to a fixed baffle and comprises a first generally elongated rigid member 116 having parallel edges 118 and 120, and which is disposed at any angle to planar axis 38 of diaphragm 10. Parallel edge 118 of rigid member 116 is connected to peripheral edge 122 of diaphragm 10 by means of flexible hinge member 124. A second rigid, generally elongated member 128 having parallel edges 130 and 132 is disposed at an angle opposite to that of rigid member 116 relative to planar axis 38 of diaphragm 10 and is connected at its edge 130 to edge 120 of rigid diaphragm 116 by means of flexible hinge member 134. The other parallel edge 132 of rigid member 128 is connected to edge 136 of fixed member 11 by means of flexible hinge 138.

As previously noted, the direction of motion of diaphragm 10 is perpendicular to planar axis 38 and similarly, the plane of flexible hinges 124, 134 and 138 is also perpendicular to planar axis 38. As diaphragm 10 moves upward as shown in position 10', it can be seen that flexible hinges 124, 134 and 138 are deformed to permit such movement and rigid members 116 and 128 are displaced accordingly. The same applies where diaphragm 10 moves to the position of diaphragm 10''.

Figure 5:
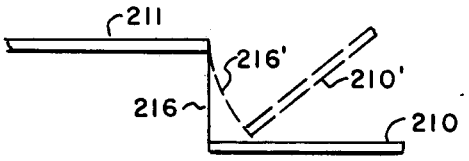
FIG. 5 is a simplified version showing the operation of a flexible hinge of FIG. 4.

With reference to FIG. 5, there is illustrated a simplified diagram showing the action of flexible hinge member 216 which is attached to rigid member 211 and movable member 210. When rigid movable member 210 is moved to position 210', flexible hinge 216 is deformed to the position 216' as shown. This is the same action taken by flexible hinges 124, 134 and 138 as diaphragm 10 moves up and down from position 10' to position 10''.

Thus, because of their perpendicular relationship to diaphragm 10 and the fact that any resonances developed in flexible hinges 124, 134 and 138 will be perpendicular to the plane of those flexible members, these vibrations will be essentially decoupled from diaphragm 10 have little or no effect in causing distortions or harmonics in the sound reproduced by diaphragm 10.

Rigid members 116 and 128, because of their small size and rigidity will have very high frequency and very low amplitude harmonics which are generally outside the frequency range of the speaker provided diaphragm 10 is relatively large compared to the area of rigid members 116 and 128.

It should also be noted that diaphragm 10, hinge 124, rigid member 116, hinge 134, rigid member 128 and hinge 132 can be fabricated out if a single sheet of plastic, such as, polyethylene, acetate, polycarbonate or the like, with diaphragm 10, rigid member 116 and 128 rigidized by dimpling or vaccum forming ridges, grooves or the like in the plastic sheet.

In a like manner, for the configuration shown in FIGS. 2 and 3, rigid members 16 and 26 (FIG. 2) and rigid members 56 and 58 (FIG. 3), because of their small size relative to the dimensions of diaphragm 10 will also produce very high frequency and very low amplitude distortions which will not effect the sound reproduction characheristics of diaphragm 10.

It should be further pointed out that diaphragm 10 can be any movable diaphragm such as a cone speaker diaphragm or a rigidized, generally flat diaphragm such as that fabricated from a light plastic sheet.

Thus is described a method and apparatus for connecting a movable diaphragm to a fixed baffle or an adjacent movable diaphragm having low resonant distortion.

Figure 6:
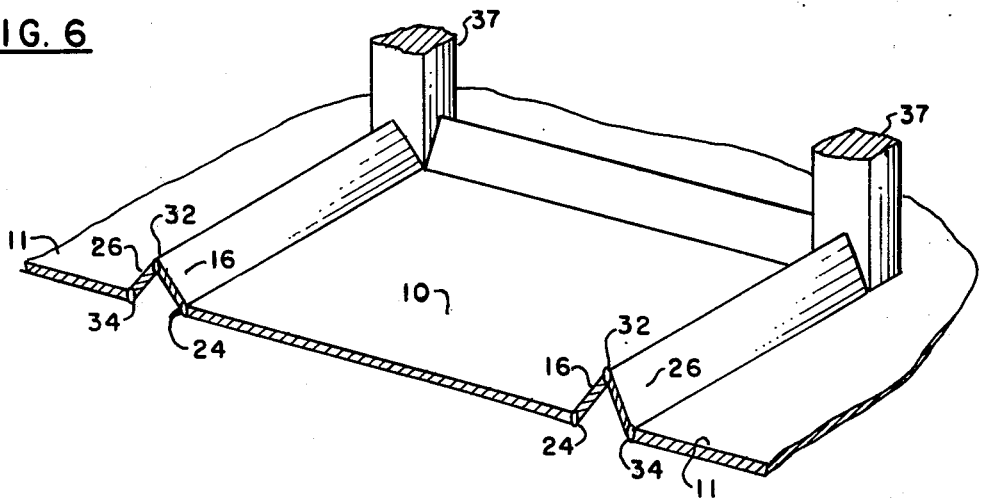
FIG. 6 is an isometric view of the connector method of the present invention showing a method of preventing air losses at the corners of the diaphragm.

With reference to FIG. 6, there is illustrated an isometric view of a movable diaphragm 10 showing the relationship of diaphragm 10 to its baffle or fixed member 11, including details of the surround connection.

In particular, the same reference numerals are used as shown in FIG. 2 showing rigid members 16 and 26 hingedly connected together by hinge 32 with hinge 24 connecting rigid member 16 to diaphragm 10 and hinge 34 connecting rigid member 26 to baffle 11.

Also shown are corner posts 37 which are used to prevent air from leaking around the corners of diaphragm 10.

Figure 7:
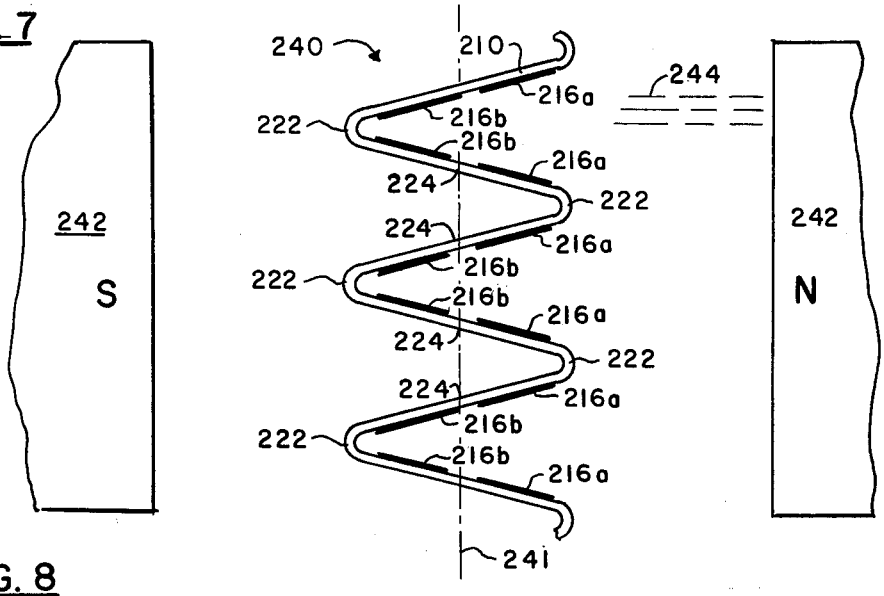
FIG. 7 is a sectional elevational view of a further embodiment of the present invention.
Figure 8:
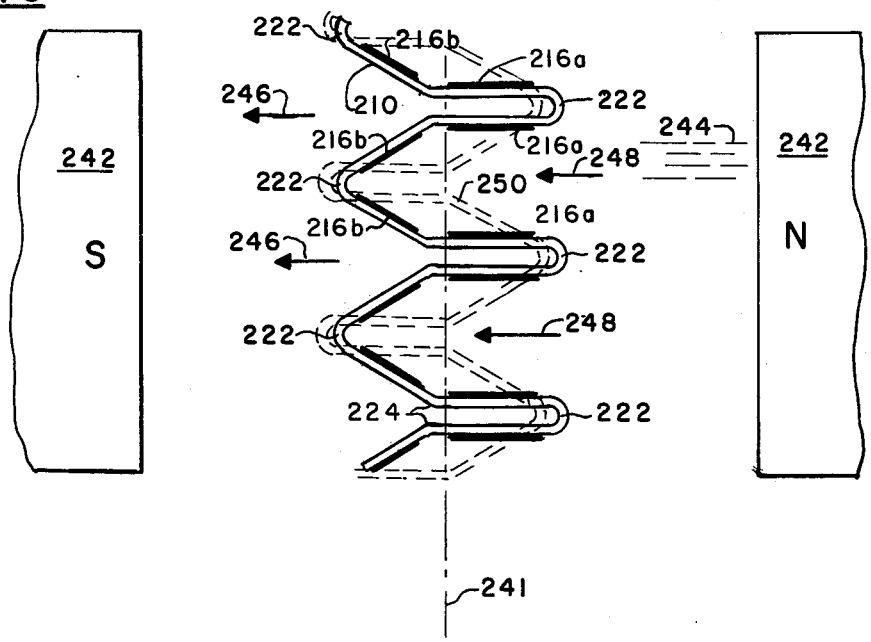
FIG. 8 is a sectional elevational view of the folded diaphragm configuration of FIG. 7 for its maximum and minimum positions of movement.
Figure 9:
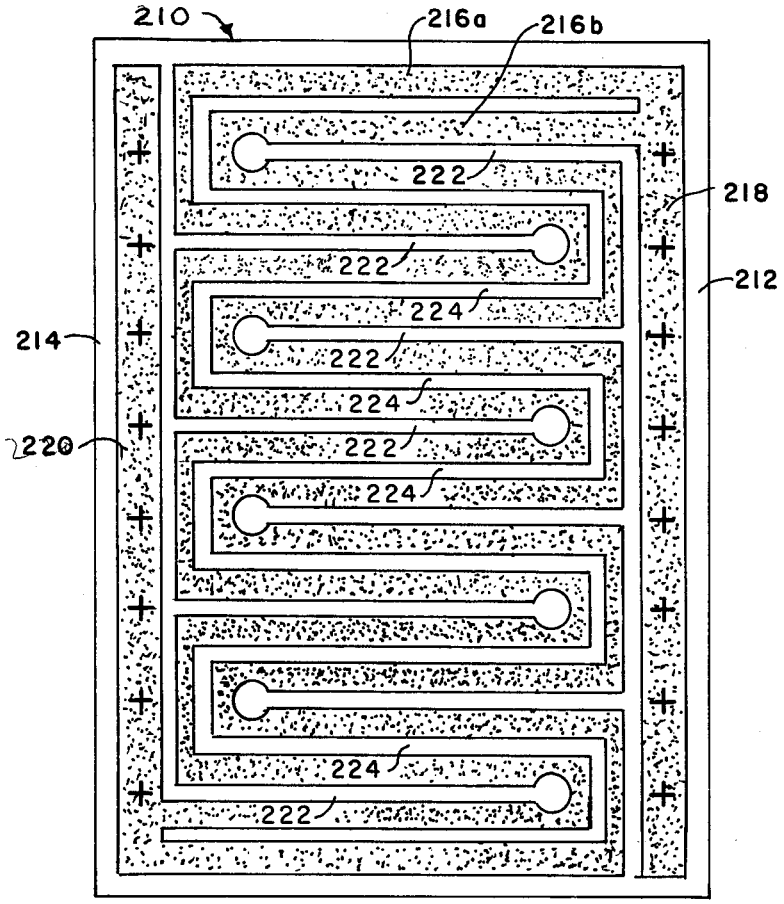
FIG. 9 is a plan view of an unfolded diaphragm of the type as used in FIGS. 7 and 9.

With reference to FIGS. 7, 8 and 9, there is illustrated a further embodiment of the present invention in which the movable diaphragms are very much smaller than the area of the surround. In particular, with reference to FIG. 7, diaphragm 240 comprises a zig-zag or angularly folded sheet of flexible, non-conductive material 210, shown in its unfolded form in FIG. 9. As shown in FIG. 9, unfolded diaphragm 240 comprises end edges 212 and 214, and on the surface of which is attached a pair of flat, parallel, narrow spaced apart conductors 216*a* and 216*b*, said pair of parallel conductors defining a narrow spaced apart meander pattern across said sheet 210 between said end edges 212 and 214. Geometrically parallel conductors 216*a* and 216*b* are also electrically connected in parallel by terminal strip 218 at one end of said meander pattern and strip terminal 220 at the other end of said meander pattern.

Plastic sheet 210 is folded into the configuration of FIG. 7 by folding in alternate directions at space 222 between each pair of conductors 216*a* and 216*b*.

As shown in FIG. 7, space 222 between parallel pairs 216*a* and 216*b* now define flexible hinge portions 222 with space 224 located between conductors 216*a* and 216*b* defining movable narrow diaphragms.

With reference to FIG. 7, it will be noted that folded sound reproduction diaphragm 240 is located between poles of permanent magnet 242 with its magnetic lines of force 244 passing through diaphragm 240 is a plane perpendicular to the planar axis 214 of diaphragm 240.

With reference to FIG. 8, when a current flows through conductors 216*a* and 216*b,* an electromotive force will be generated perpendicular to the lines of force 244 of permanent magnet 242 causing a force to be applied to flexible member 210. Since conductors 216*a* and 216*b,* by virtue of their meander pattern, are connected also in series in the folded configuration of diaphragm 240, the forces on alternate folds will be in the opposite direction such that alternate conductors in adjacent folds, in one case will be pushed towards each other, and in the other adjacent fold pushed away from each other such that air will flow out of one side of diaphragm 240 as indicated by arrows 246 and flow into diaphragm 240 as shown by arrows 248.

When the current reverses its direction of flow through conductors 216*a* and 216*b,* the forces will be reversed causing diaphragm 240 to assume the position indicated by dashed lines 250 resulting in an air flow in the opposite direction. Thus the movement of very narrow diaphragm 224 and its surround, defined by the rigid strip portions 216*a* and 216*b,* will produce sound having very low resonant distortion.

Figure 10:
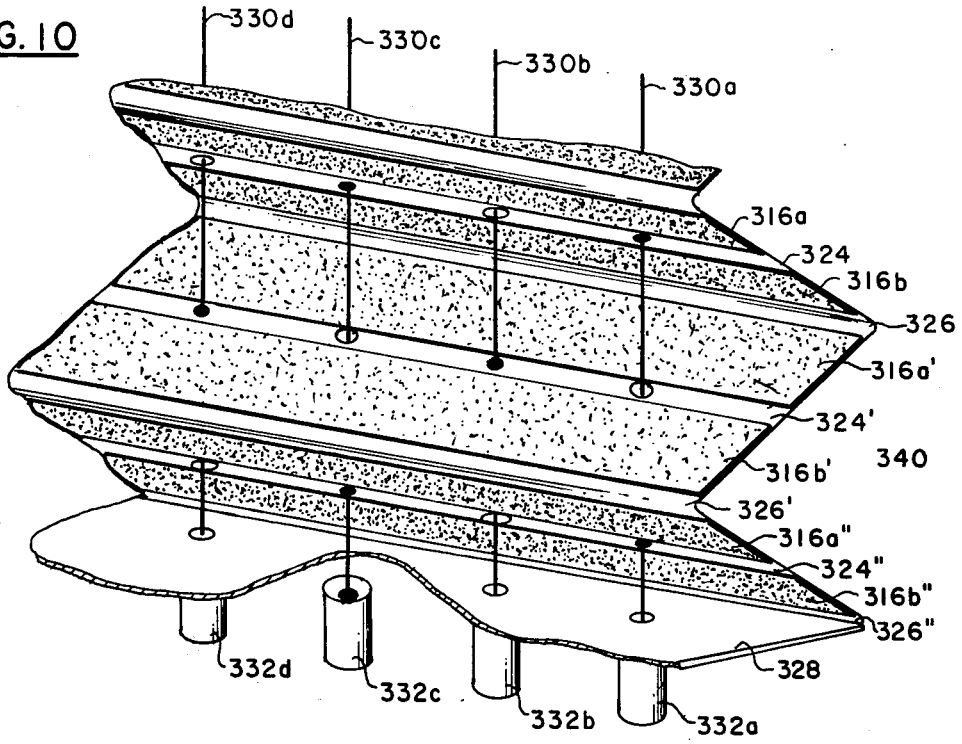
FIG. 10 is an isometric partial view of the diaphragm of the type illustrated in FIGS. 7 and 8 utilizing an indirect drive system.

With reference to FIG. 10, there is illustrated a further embodiment of the apparatus of the present invention utilizing the folded diaphragm configuration of FIGS. 7 and 8, however, utilizing an indirect drive to achieve movement of the individual folds rather than metallic conducting strips attached to the folds as used in FIGS. 7 and 8.

Folded diaphragm 340 comprises, basically, generally rigid members 316*a* and 316*b* which are hingedly connected to each other by hinge member 324 to define a sound reproducing fold member having edges hingedly connected to an adjacent fold member. In particular, the remaining unconnected edge of rigid member 316*b* is hingedly connected to the other unconnected edge of adjacent fold rigid member 316*a'* by hinge 326. In a like manner, the unconnected edge of rigid member 316*b'* is hingedly connected to the other unconnected edge 316*a''* of adjacent fold member by hinge 326'. The other unconnected edge of rigid member 316*b''* is shown connected to rigid base member 328 by means of hinge 326''.

Movement of the indirect drive configuration of FIG. 10 is achieved by utilizing a plurality of drive elements, drive rods or strings under tension 330*a,* 330*b,* 330*c* and 330*d* in which alternate drive elements are connected to alternate folds at hinge points 324' and 324''. In particular drive element 330*a* is connected to hinges 324 and 324'' whereas it passes through hinge 324'. Drive element 330*b* is connected to hinge 324' but passes through hinges 324 and 324''. In a like manner drive element 330*c* is connected in the same manner as drive element 330*a,* while drive element 330*d* is connected in the same manner as drive element 330*b.* All drive elements are driven, respectively, by coils or solenoids 332*a,* 332*b,* 332*c* and 332*d* actuating drive elements 330*a,* 330*b,* 330*c* and 330*d.* Although individual coils 332 are used to drive each drive element, a pair of coils or a pair of straight current carrying drive strips (not shown), which are each attached to alternate drive elements would also perform the same function.

In operation, as coils 332*a* and 332*c* actuate drive elements 330*a* and 330*c* in the upward direction, coils 332*b* and 332*d* simultaneously actuate drive elements 330*b* and 33*d* in the downward direction. Thus it can be seen that, in that situation, hinges 324 and 324'' are moved away from each other, whereas hinges 324' and 324'' are moved toward each other. As drive elements 330 move in a cyclical motion, the movement of diaphragm 340 is the same as that shown in FIG. 8 whereby air is simultaneously pushed out of one side of diaphragm 340 while being pulled into the other side of diaphragm 340.

I claim:

1. A connector for a movable diaphragm comprising a fixed member, a movable diaphragm member having a planar axis and adapted to move in a direction perpendicular to said planar axis relative to said fixed member, a first rigid, generally elongated member having elongated parallel edges, said member being disposed at an angle to said planar axis about the periphery of said movable diaphragm, a first hinge member hingedly connecting one elongated edge of said first rigid elongated member to said movable diaphragm comprising a first generally planar, elongated flexible member having elongated parallel edges, said member disposed with its planar axis parallel to the direction of motion of said movable diaphragm and having one edge fixedly attached to said movable diaphragm and the other parallel edge fixedly attached to one elongated edge of said first rigid member, a second rigid, generally elongated member having elongated parallel edges, said member being disposed at an angle to said planar axis opposite the angle of said first rigid member, a second hinge member hingedly connecting the other parallel elongated edge of said first rigid member to one elongated edge of said second rigid member comprising a second generally planar, elongated flexible member having elongated parallel edges disposed with its planar axis parallel to the direction of motion of said movable diaphragm and having one edge fixedly attached to the other parallel edge of said first rigid member and the other parallel edge of said second flexible member fixedly attached to one edge of said second movable member, and a third hinge member hingedly connecting the other parallel elongated edge of said second rigid member to said fixed member comprising a third generally planar, elongated flexible member having elongated parallel edges disposed with its planar axis parallel to the direction of motion of said movable diaphragm and having one edge fixedly attached to the other parallel edge of said second rigid member, and the other parallel edge of said third flexible member fixedly attached to said fixed member.

2. An electro-acoustic transducer comprising a plurality of parallel arranged, elongated, narrow, generally planar pairs of first and second rigid members, a first hinge member hingedly connecting said pair of first and second rigid members to each other, a second hinge member hingedly connecting said pairs of rigid members to adjacent pairs of rigid members, said pairs of rigid members alternately folded at said second hinge member to define a plurality of angular corrugations having adjacent narrow open air spaces facing in opposite directions, and means for moving alternate adjacent first hinge members toward and away from each other.

3. An electro-acoustic transducer comprising means for producing a magnetic field, a diaphragm located in said magnetic field with the plane of said diaphragm generally perpendicular to the lines of force of said magnetic field, said diaphragm comprising a plurality of parallel arranged, elongated, narrow, generally planar, rigid members hingedly connected to each other along their elongated edges and folded in opposite directions at every second hinged connection to define a plurality of angular corrugations having adjacent narrow open air spaces facing in opposite directions in which a pair of rigid elongated members are located between each fold, a conductor attached to each of said rigid members, means for electrically connecting said conductors of each pair of rigid elongated members in parallel, and means for electrically connecting said parallel connected conductors in series with electrical conductors attached to adjacent pairs of rigid members.

* * * * *